United States Patent [19]

Brinsa

[11] Patent Number: 4,726,165

[45] Date of Patent: Feb. 23, 1988

[54] UNDERSTRUCTURE FOR A PANEL LINING

[75] Inventor: Werner Brinsa, Heppenheim, Fed. Rep. of Germany

[73] Assignee: Hunter Douglas International N.V., Curacao, Netherlands Antilles

[21] Appl. No.: 875,432

[22] Filed: Jun. 17, 1986

[30] Foreign Application Priority Data

Jun. 26, 1985 [DE] Fed. Rep. of Germany ..... 3522803

[51] Int. Cl.[4] ..... E04C 2/42

[52] U.S. Cl. ..... 52/665; 52/484; 52/713

[58] Field of Search ..... 52/484, 488, 489, 703, 52/712, 713, 714, 715, 483, 665, 664, 690, 721

[56] References Cited

U.S. PATENT DOCUMENTS

| | | | |
|---|---|---|---|
| 2,499,278 | 2/1950 | Olsen | 52/714 X |
| 3,013,644 | 12/1961 | Smith et al. | 52/690 X |
| 3,163,266 | 12/1964 | Nelsson | 52/484 X |
| 3,612,461 | 10/1971 | Brown | 52/484 X |
| 3,831,338 | 8/1974 | Klingensmith et al. | 52/721 X |
| 4,040,758 | 8/1977 | Sauer | 52/665 X |
| 4,610,562 | 9/1986 | Dunn | 52/665 X |

FOREIGN PATENT DOCUMENTS

| | | | |
|---|---|---|---|
| 2652481 | 5/1978 | Fed. Rep. of Germany . | |
| 3049346 | 7/1982 | Fed. Rep. of Germany | 52/484 |
| 48023 | 3/1965 | German Democratic Rep. | 52/483 |
| 2152090 | 7/1985 | United Kingdom | 52/484 |

*Primary Examiner*—Carl D. Friedman

*Attorney, Agent, or Firm*—Pennie & Edmonds

[57] ABSTRACT

An understructure for a panel lining, such as a panel false ceiling, and for securing the lining panels to the building surface to be lined, including a first set of parallel elongate rails and a second set of parallel elongate rails extending transversely thereto, the two sets of rails being of same or similar cross-section and the rails of the first set overlying the rails of the second set at cross-over points, cross-over connections being provided to secure the rails of the first set to the rails of the second set. These connections include an upper connecting part engagable over the rail of the first set and a lower clamping part engagable over the rail of the second set at the associated cross-over point to hold the cross-over connection to the rail of the second set. Fixing means include an upper fixing part securable to the building structure and a lower clamping part substantially identical to the lower clamping part of the cross-over connection, these being engagable over a rail of the first set to hold the fixing means thereto.

9 Claims, 7 Drawing Figures

7
7a
4
6
15
16
10
11
8
12
5
9
13
22
19
21
20
17
18
27

UNDERSTRUCTURE FOR A PANEL LINING

FIELD OF THE INVENTION

The present invention relates to an understructure for a panel lining, for example a panelled false ceiling, the understructure being used to secure lining panels to a building surface to be lined.

BRIEF DESCRIPTION OF THE PRIOR ART

One form of conventional understructure includes a first set of parallel elongate rails extending in a generally longitudinal direction and a second set of parallel elongate rails extending transversely to the rails of the first set, the rails of the first set overlying the rails of the second set at cross-over points. It is conventional to have the cross-section of the profiled structure of the rails of the two sets identical or similar. Cross-over connections are provided to secure the rails of the first set to those of the second.

In one particular arrangement these cross-over connections are made in one piece in a U-shape with legs of unequal length, with, in each case, the long leg having two lugs in the upper area which are stamped out in opposite directions and engage the arms of the upper rail. The lower rail is held in a recess shaped to correspond to its cross-section. The cross-over connection consequently has a very complicated configuration and can only be positioned on the lower rail by passing it over the end of the rail. If the rail is fairly long and a number of cross-over connections are necessary this will require them to be moved a considerable distance along the rail, which involves a very considerable amount of assembling and dismantling work.

Moreover it is usually necessary for the two legs of the U-shaped cross-section to extend substantially parallel to one another, or else the cross-section would be tilted on the upper part of the rail and would no longer be longitudinally displacable. However, since the cross-section of the cross-over connection is normally made of flat stamped material, its legs can usually bend easily towards one another making assembly and dismantling again difficult. The fixing to the building ceiling is effected by hangers which pass through openings formed in the rails of the first set.

Thus one has to have totally different and rather complicated parts which is unsatisfactory.

SUMMARY OF THE INVENTION

An object of the present invention is to provide an understructure for a panel lining which is relatively easy to assemble and dismantle and is formed with components which can be of a simple structure which can be made reliably and used with great stability.

It is proposed, according to the invention, to provide an understructure for a panel lining, such as a panelled false ceiling, for securing lining panels to a building surface to be lined, said understructure comprising:

(a) a first set of parallel elongate rails extending longitudinally;

(b) a second set of parallel elongate rails extending transversely to the rails of the first set, the rails of the first set overlying the rails of the second set at cross-over points and having a cross-section generally similar to that of the first set, said cross-section enabling the panels to be secured to said second set of rails;

(c) cross-over connections to secure the rails of the first set to the rails of the second set;

(d) an upper connecting part of each cross-over connection engagable over the rails of the first set at the associated cross-over point to hold the rail of the first set down on the rail of the second set;

(e) a lower clamping part of each cross-over connection engagable over the rail of the second set, at the associated cross-over point, to hold the cross-over connection to the rail of the second set;

(f) fixing means secured to the rails of the first set effective to hold said understructure to said building surface;

(g) an upper fixing part of said fixing means securable to said building surface; and (h) a lower clamping part of said fixing means, substantially identical to the lower clamping part of said cross-over connection, engagable over a rail of the first set, to hold said fixing means to said rail of the first set.

With such a construction, it is possible to use lower clamping parts which are identical both for the cross-over connections and for the fixing means.

Advantageously the lower clamping parts are formed separately from, and are detachable from, the associated upper connecting part or upper fixing part and they may, for example, be in the form of a U-shaped cross-section having two arms, each having a portion resiliently engagable under the lower edge of the associated rail of the first or second set.

The lower clamping parts may have a cross-section including a web and two arms, and the upper connecting parts and the upper fixing parts preferably include at least one slot, whereby at least one arm of the associated lower clamping part may be passed downwardly through said at least one slot, whereby said web can engage the upper connecting part or the upper fixing part, adjacent said at least one slot.

One of the advantages of the construction of the present invention is that because the lower clamping part of the cross-over connections can be made identical with the lower clamping part of the fixing means, these parts can be mass produced efficiently and can be formed separately from the upper clamping and fixing parts. However, in order to maintain the integrity of the cross-over connections and the fixing parts, the lower clamping parts are preferably affixed securely to the upper connecting parts and the upper fixing parts and this may achieved, for example, by welding or probably the simplest construction, by forming lugs on the upper connecting parts and the upper fixing parts, adjacent the slots thereof, these lugs being bendable over the webs of the lower clamping parts to securely fix said lower fixing parts thereto.

The upper connecting parts may take many different forms but in one advantageous constructing they comprise a horizontal leg having the slot or slots formed therein, an upturned leg being connected to the horizontal leg and having a part thereof engagable over the rail of the first set. Thus the upturned part of the connecting parts can generally conform to the cross-section of the rail.

By having a U-shape construction the lower clamping parts of both the cross-over connection and the fixing means can simply be sprung over the top of the rail at any location and there is no need to slide the cross-over connection along the length of the rail. Advantageously the lower clamping parts have the same cross-section as the rails, the dimension being such as to provide minimum tolerance, whereby the cross-over connections can have a perfect seat in situ. In this way the cross-over connections can clamp in a self-locking manner and the lower clamping sections preferably grip over the rails, preferably in a clamping manner, and grip beneath the rails, for example at their lower edges. This can also be used in clamping of the panels.

In this connection, the rails themselves preferably each include an upper substantially flat web, two spaced legs extending downwardly from said web from each end thereof, to form a substantially channel cross-section, and inturned flanges angled upwardly from the lower edges of the legs and engagable with one another, to provide shoulders against which inturned securing rims of the panels to be supported are lockingly engagable.

If such a cross-section of rail is clipped into one of the lower clamping parts of the fixing means or of the cross-over connections, the arms of the clamps match the legs of the rails and exert a clamping effect on the legs of the rails, thus on the clamping and bearing shoulders, which are supported against one another, which therefore contribute to a more reliable holding of the lining panels. Thus, the clamping parts not only form a holding function but also assist in gripping the panel. In this connection it may be advantageous to use clamping parts additionally between the cross-over points if additional clamping action is required.

The upper fixing part can also take many forms and one form includes a horizontal portion having at least one slot formed therein and apertures in the flat portion for securing means such as screws, bolts, or the like. An alternative construction is of an angled type including a horizontal flat portion having the slot or slots formed therein and angled flat portion connected to said horizontal portion and, for example, extending upwardly therefrom and having apertures therein for securing means such as screws or bolts.

In order that the invention may fully be understood, the following detailed description of a presently preferred embodiment of the invention is given by way of example:

DETAILED DESCRIPTION OF PRESENTLY PREFERRED EMBODIMENT

Figure 1:
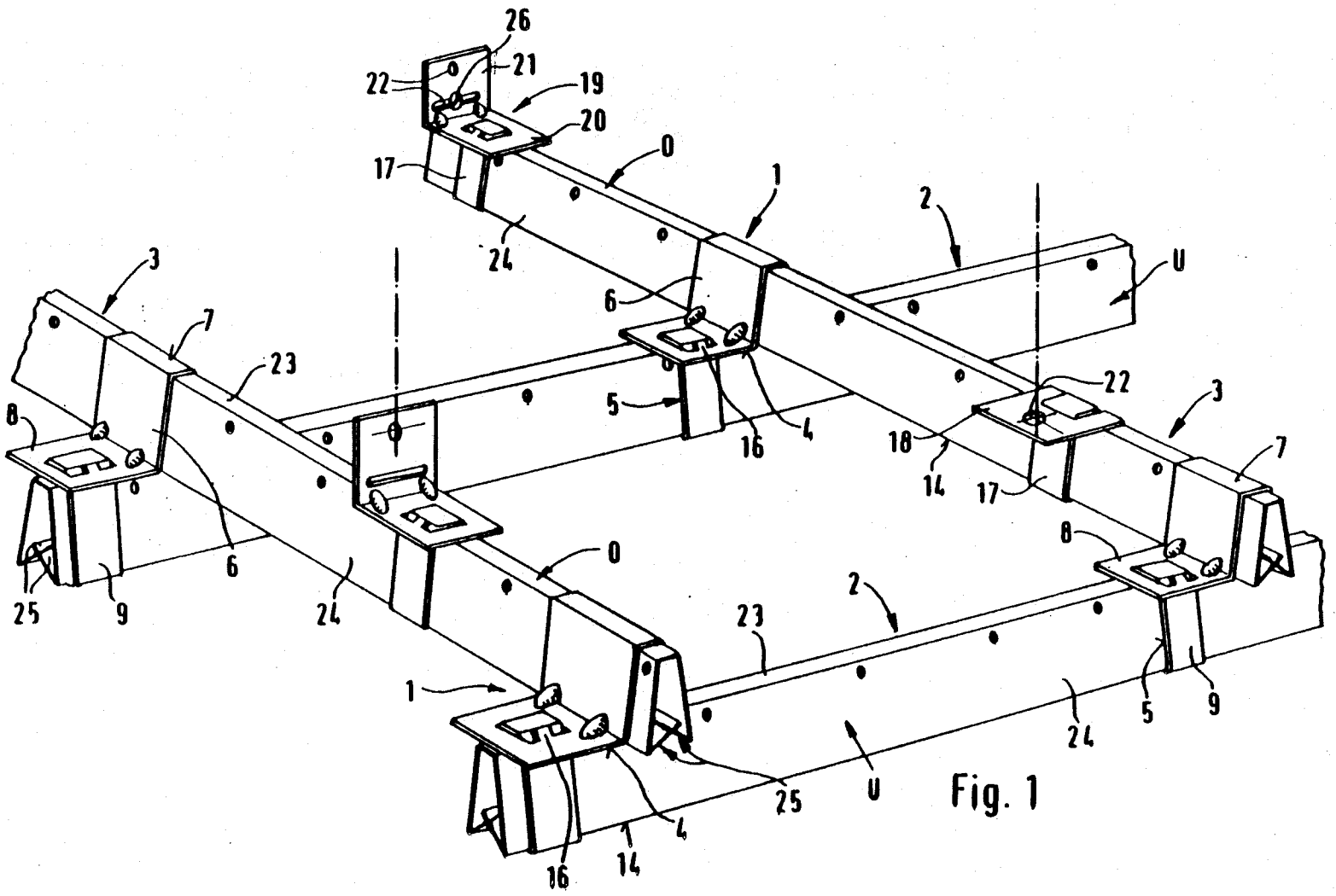
FIG. 1 is a perspective view of one embodiment of understructure according to the invention with the building surface to which it has been connected and the panels themselves omitted.

The understructure according to FIG. 1 is intended for a false ceiling of lining panels (not shown) which hangs on a building ceiling to be lined. When applying the invention to a wall or facade lining, the terms "upper" and "lower" and "above" and "below" should therefore be changed accordingly. The understructure has a first set of parallel longitudinal rails 2 and a second set of parallel transverse rails 3, extending transversely thereto, the rails of the first crossing below the rails of the second set at cross-over points, where they are connected to one another by means of cross-over connections 1. The longitudinal and transverse rails 2 and 3 are made as profiled upper rails O and profiled lower rails U, at least externally having the same or almost the same cross-section. The rails O and U have a generally channel-shaped cross-section including an upper, substantially flat connecting web 23 and, on the opposite longitundinal edges of the latter, downwardly extending legs 24 which diverge slightly from one another. At their lower edges, the legs have internal flanges 25, engagable with one another to form clamping and bearing shoulders for the inturned securing rims of the edges of the lining panels. Consequently, the lining panels can be clamped on the flanges 25 of adjacent lower rails U, which are spaced from one another accordingly. The upper rails O are used for mounting the lower rails U at the correct spacing and connecting them to the building surface, e.g. a ceiling or wall.

Figures 2A, 2B, 3A, 3B, 4A, 4B:
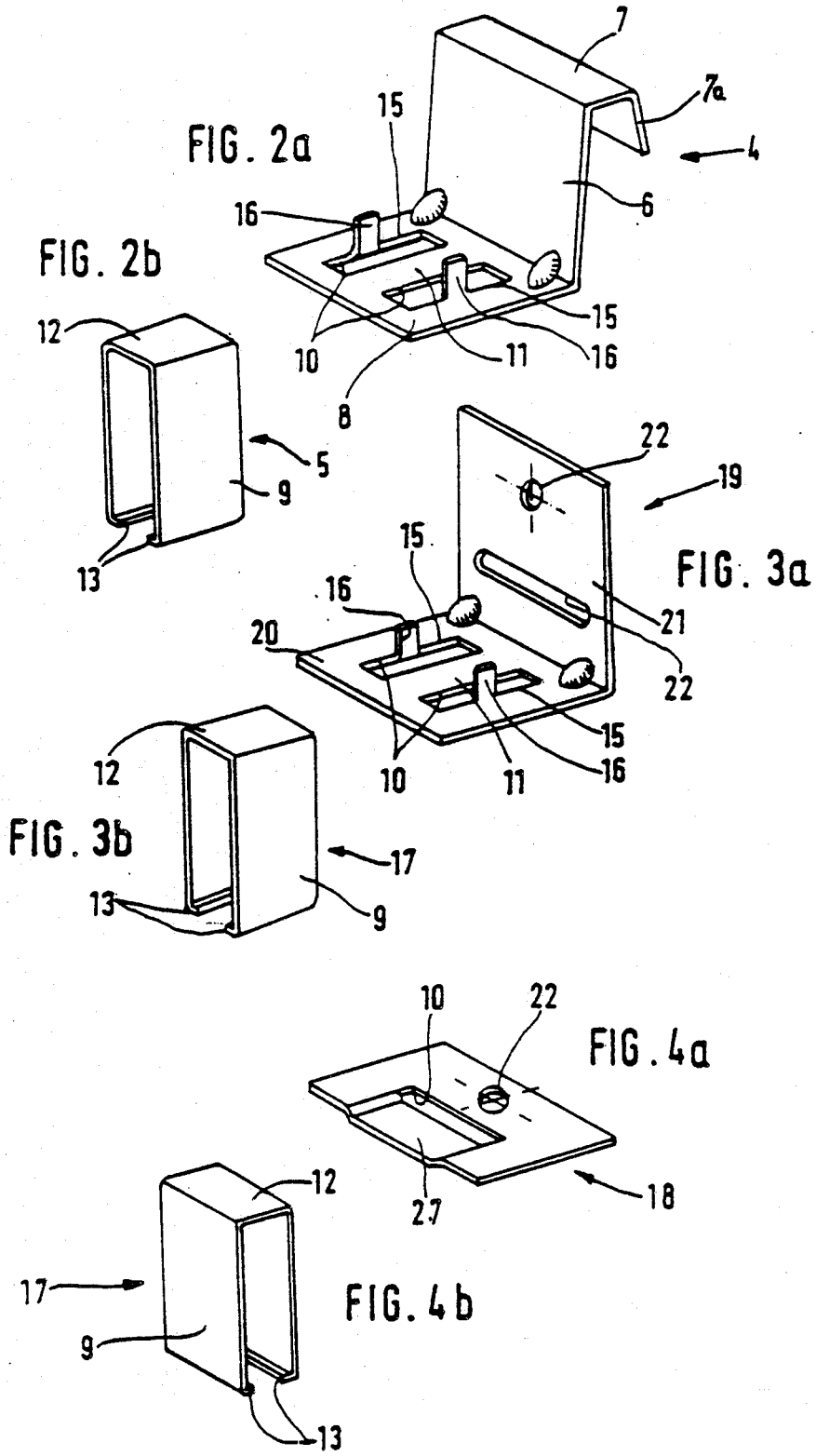
FIGS. 2*a* and 2*b* are exploded perspective views of the upper connecting part and the lower clamping part of one form of cross-over connection of the understructure.
FIGS. 3*a* and 3*b* show exploded perspective views of an angled upper fixing part and lower clamping part of a fixing means of the understructure.
FIGS. 4*a* and 4*b* show similar views of a flat fixing means.

The cross-over connections 1 have an angular upper connecting part 4 and lower clamping part 5. The part 4 has a horizontal leg 8 and an upturned leg 6, which has a horizontal upper portion 7, with a downturned portion 7*a* at its free end. Portions 6, 7 and 7*a* are thus adapted to the shape of the upper rail O, with minimum tolerance, to give a reliable seating for the rail while the separate cross-over points can be accurately aligned by the longitudinal displaceability of the cross-over connections 1. On the horizontal leg 8 of the upper part 4, are formed two slots 10 which are substantially parallel to one another and to the side edges of the upper part 4 and are separated by a central area 11, see FIG. 2*a*. The slots 10 are spaced by a distance approximately corresponds to the distance of the downwardly extending legs 9 of the lower clamping part 5, so that part 5, with its legs 9 initially substantially parallel, can be pressed downwardly through the slots 10, until its substantially flat centre web 12 bears on the central area 11. For temporarily fixing the clamp 5 to the horizontal leg 8 of the angle 4, lugs 16 according to FIG. 1 can be bent inwardly to engage the centre web 12 of the clamping part 5 and hold it against the central area 11. The lugs 16, as can be seen from FIG. 2*a*, are located adjacent the outer edges 15 of the slots 10 and are integral with the horizontal leg 8. In the installed condition, the two legs 9 of the clamping part 5 grip over the lower rail u and increase its clamping force. Moreover, the legs 9, with inturned beads 13 provided at their lower ends, grip beneath the lower edges 14 of the respective lower rail U, so that the latter is supported by the clamping part 5. With such a construction, the cross-over connections 1 can first be fitted over upper rails O at the required spacings, after which the lower rail U is clipped from below into the clamping parts 5 of the cross-over connections 1.

The fixing means for suspending the understructure with its longitudinal and transverse rails 2 and 3, consist of a second lower clamping part 17 which is the same shape as the first lower clamping part 5 and an upper fixing part 18, 19. The legs 9 of the lower clamping part 17, as shown in FIGS. 3*a* and 3*b*, pass through two slots 10, in a horizontal leg 20 of an angled upper fixing part 19, the slots running parallel to one another and to the marginal edges of the upper fixing part 19. The clamping part 17, by the bending over of appropriate lugs 16 at the outer edges 15 of the slots 10, which lugs grip over the centre web 12 of the clamping part 17, can be fastened to the leg 20 of the angular fixing means 19. FIG. 1 shows how such an angular fixing part 19 can be clipped onto the upper rail O, as a result of which the leg 21 projects substantially perpendicularly upwards from the upper rail O and has holes or slots 22, so that fixing elements such as screws, bolts 26 can be passed through for fixing to a vertical wall or for suspending a hanger.

Instead of an angular fixing part 19, a flat upper fixing part 18 can also be provided which, for example, is substantially the same shape as the horizontal leg 8 of the upper part 4 of the cross-over connection 1 or the horizontal leg 20 of the angular fixing part 19, apart from additional holes or slots 22. However, the flat upper fixing part 18 can also have the simplified shape shown in FIG. 4*a*, in which only one slot 10 is provided for the passage of a leg 9 of the clamping part 17, whereas the other leg 9 bears against the adjacent outer edge of the flat fixing part 18, and the flat centre web 12 connecting the legs 9 lies in a bridge 27 between the slot 10 and the adjacent edge, so that the upper side of the centre web 12 is aligned with the upper side of the flat fixing part 18, as is apparent from FIG. 1. The hole 22 provided in the area next to the slot 10 of the flat fixing part 18 is used for locating a vertical hanger, another fixing element for direct fixing to the building ceiling or direct fixing of the understructure to a wall for forming vertical wall linings.

It is apparent that the majority of the parts of the described understructure can consist of sheet metal and be punched or stamped from the latter. It is possible to manufacture the understructure very efficiently, since the rails 2 and 3 are made as clamping section rails O and U of the same shape, lower clamping parts 5 and 17 of the same shape are used for both the cross connections 1 and for fastening the flat and angular fixing means 18 and 19 by clipping onto the upper rails O, and finally even the horizontal legs 8 and 20 and if necessary even the flat fixing means 18 can be of the same shape. Moreover, assembly and dismantling is considerably facilitated in that the cross-over connections 1 and the suspension means need not be pushed onto the rails 2 or 3 over substantial partial lengths of the latter, but can be clipped on in situ. Since the assembly time represents a significant factor for the costs of such false ceilings or wall linings, the latter can consequently be made available more economically than before.

I claim:

1. An understructure for a panel lining, such as a panelled false ceiling, for securing lining panels to a building surface to be lined, said understructure comprising:

(a) a first set of parallel elongate rails extending longitudinally;

(b) a second set of parallel elongate rails extending transversely to the rails of the first set, the rails of the first set overlying the rails of the second set at crossover points and having a cross-section generally similar to that of the first set, said cross-section enabling the panels to be secured to said second set of rails;

(c) crossover connections to secure the rails of the first set to the rails of the second set;

(d) an upper connecting part of each crossover connection engagable over the rails of the first set at the associated crossover point to hold the rail of the first set down on the rail of the second set;

(e) a lower clamping part of each crossover connection engagable over the rail of the second set, at the associated crossover point, to hold the crossover connection to the rail of the second set;

(f) fixing means secured to the rails of the first set effective to hold said understructure to said building surface;

(g) an upper fixing part of said fixing means securable to said building surface; and (h) a lower clamping part of said fixing means, substantially identical to the lower clamping part of said crossover connection, engagable over a rail of the first set, to hold said fixing means to said rail of the first set, said lower clamping part formed separately from, and detachable from, the upper connecting part or upper fixing part.

2. An understructure as claimed in claim 1, wherein said lower clamping parts each comprise two arms, each having a portion resiliently engagable under the lower edge of the associated rail of the first or second set.

3. An understructure as claimed in claim 1, wherein said upper fixing parts comprise a horizontal flat portion having said at least one slot formed therein, and an angled flat portion connected to said horizontal flat portion and apertures in said angled flat portion for securing means.

4. An understructure as claimed in claim 1, wherein said rails each include an upper, substantially flat web, two spaced legs extending downwardly from said web, from end edges thereof, to form a substantially channel cross-section, and inturned flanges angled upwardly from the lower edges of said legs and engagable with one another, to provide shoulders against which inturned securing rims of panels to be supported are lockingly engagable.

5. An understructure for a panel lining, such as a panelled false ceiling, for securing lining panels to a building surface to be lined, said understructure comprising:

(a) a first set of parallel elongate rails extending longitudinally;

(b) a second set of parallel elongate rails extending transversely to the rails of the first set, the rails of the first set overlying the rails of the second set at crossover points and having a cross-section generally similar to that of the first set, said cross-section enabling the panels to be secured to said second set of rails;

(c) crossover connections to secure the rails of the first set to the rails of the second set;

(d) an upper connecting part of each crossover connection engageable over the rails of the first set at the associated crossover point to hold the rail of the first set down on the rail of the second set;

(e) a lower clamping part of each crossover connection engagable over the rail of the second set, at the associated crossover point, to hold the crossover connection to the rail of the second set;

(f) fixing means secured to the rails of the first set effective to hold said understructure to said building surface;

(g) an upper fixing part of said fixing means securable to said building surface; and (h) a lower clamping part of said fixing means, substantially identical to the lower clamping part of said crossover connection, engagable over a rail of the first set, to hold said fixing means to said rail of the first set, said lower clamping part formed separately from, and detachable from, the upper connecting part or upper fixing part, wherein said lower clamping parts are formed as inverted U- or V-shaped members, having a web and two arms, and wherein said upper connecting parts and said upper fixing parts each include at least one slot, whereby at least one arm of the associated lower clamping part may be passed downwardly through said at least one slot, whereby said web can engage said upper connecting part of the upper fixing part adjacent said at least one slot.

6. An understructure as claimed in claim 5, wherein said lower clamping parts are affixed securely to the upper connecting parts and said upper fixing parts.

7. An understructure as claimed in claim 6, and further comprising tangs on said upper connecting parts and said upper fixing parts, adjacent the slot thereof, said tangs being bendable over the webs of said lower clamping parts to securely affix said lower clamping parts thereto.

8. An understructure as claimed in claim 6, wherein said upper fixing parts comprise a horizontal flat portion having said at least one slot formed therein and apertures in said flat portion for securing means.

9. An understructure for a panel lining, such as a panelled false ceiling, for securing lining panels to a building surface to be lined, said understructure comprising:

(a) a first set of parallel elongate rails extending longitudinally;

(b) a second set of parallel elongate rails extending transversely to the rails of the first set, the rails of the first set overlying the rails of the second set at crossover points and having a cross-section generally similar to that of the first set, said cross-section enabling the panels to be secured to said second set of rails;

(c) crossover connections to secure the rails of the first set to the rails of the second set;

(d) an upper connecting part of each crossover connection engageable over the rails of the first set at the associated crossover point to hold the rail of the first set down on the rail of the second set, said upper connecting parts comprising a horizontal leg having at least one slat form therein, an upturned leg connected to said horizontal leg and a part of said upturned leg engagable over a rail of the first set of parallel elongated rails;

(e) a lower clamping part of each crossover connection engagable over the rail of the second set, at the associated crossover point, to hold the crossover connection to the rail of the second set;

(f) fixing means secured to the rails of the first set effective to hold said understructure to said building surface;

(g) an upper fixing part of said fixing means securable to said building surface; and (h) a lower clamping part of said fixing means, substantially identical to the lower clamping part of said crossover connection, engagable over a rail of the first set, to hold said fixing means to said rail of the first set, said lower clamping part formed separately from, and detachable from, the upper connecting part or upper fixing part.

* * * * *